US005899603A

United States Patent [19]

Markovics

[11] Patent Number: 5,899,603

[45] Date of Patent: May 4, 1999

[54] IMAGING MODULE EMPLOYING FRICTIONAL DRIVE

[75] Inventor: James M. Markovics, Rochester, N.Y.

[73] Assignee: Xerox Corporation, Stamford, Conn.

[21] Appl. No.: 09/003,695

[22] Filed: Jan. 7, 1998

[51] Int. Cl.[6] ..... G03G 15/00

[52] U.S. Cl. ..... 399/167; 399/111

[58] Field of Search ..... 399/111, 116, 399/130, 159, 167, 236, 299

[56] References Cited

U.S. PATENT DOCUMENTS

| | | | |
|---|---|---|---|
| 4,975,744 | 12/1990 | Ebata et al. . | |
| 5,126,800 | 6/1992 | Shishido et al. | 399/111 |
| 5,243,384 | 9/1993 | Everdyke et al. . | |
| 5,307,117 | 4/1994 | Harlan . | |
| 5,402,207 | 3/1995 | Michlin . | |
| 5,418,600 | 5/1995 | Genovese | 399/167 |
| 5,421,255 | 6/1995 | Kryk | 399/167 X |
| 5,428,426 | 6/1995 | Inomata et al. | 399/167 |
| 5,537,189 | 7/1996 | Imes . | |
| 5,740,493 | 4/1998 | Otaki et al. | 399/299 X |
| 5,778,287 | 7/1998 | Yu | 399/167 |

*Primary Examiner*—Sandra Brase
*Attorney, Agent, or Firm*—Zosan S. Soong

[57] ABSTRACT

A detachable imaging module for an electrostatographic printing apparatus, including: (a) a housing; (b) a cylindrical, rotatable photoreceptor at least partially disposed within the housing, wherein the photoreceptor has a non-imaging area; and (c) a frictional drive apparatus in contact with the non-imaging area for facilitating rotation of the photoreceptor by frictional contact, wherein there is absent a rotational drive gear coupled to the photoreceptor.

4 Claims, 4 Drawing Sheets

IMAGING MODULE EMPLOYING FRICTIONAL DRIVE

FIELD OF THE INVENTION

This invention relates to a customer replaceable unit for an electrostatographic printing machine. The phrase printing machine includes both printing and copying devices.

BACKGROUND OF THE INVENTION

Electrostatographic printing machines have been developed which use one or more replaceable sub-assemblies called customer replaceable units (CRU). One typical CRU contains the photoreceptor and the necessary supporting hardware therefor assembled in a single unit designed for insertion and removal into and out of the machine by the user. When the CRU is no longer operational, the old CRU is removed and a new one installed.

For small cylindrical photoreceptors in correspondingly small CRUs, drive gears are relatively expensive, necessitating shafts, bearing surfaces, and flanges to attach to the photoreceptor, as well as inherently mechanically noisy due to the discrete nature of momentum transfer in a toothed gear system. In addition, ensuring surface motion tracking between the image-writing laser beam and the transfer point of toner to paper to ensure faithful digital image reproduction in a monochrome printer or color fidelity in a tandem color printing machine in which the surface motion tracking additionally must follow from photoreceptor to photoreceptor as well as within the photoreceptor, relies on both uniform rotation rate and controlled photoreceptor radji to minimize error in a gear driven system. The present invention achieves the necessary motion quality while using reduced cost parts and relaxing the radial uniformity requirements for the photoreceptor.

Conventional consumer replaceable units are disclosed in Imes, U.S. Pat. No. 5,537,189; Ebata et al., U.S. Pat. No. 4,975,744; Harlan, U.S. Pat. No. 5,307,117; and Everdyke et al., U.S. Pat. No 5,243,384, the disclosures of which are totally incorporated herein by reference. In addition, Michlin, U.S. Pat. No. 5,402,207, discloses a long-life and improved photoreceptor drum gear.

SUMMARY OF THE INVENTION

The present invention is accomplished in embodiments by providing a detachable imaging module for an electrostatographic printing apparatus, comprising:

(a) a housing;

(b) a cylindrical, rotatable photoreceptor at least partially disposed within the housing, wherein the photoreceptor has a non-imaging area; and (c) a frictional drive apparatus in contact with the non-imaging area for facilitating rotation of the photoreceptor by frictional contact, wherein there is absent a rotational drive gear coupled to the photoreceptor.

BRIEF DESCRIPTION OF THE DRAWINGS

Other aspects of the present invention will become apparent as the following description proceeds and upon reference to the FIGS. which represent preferred embodiments.

Unless otherwise noted, the same reference numeral in different FIGS. refers to the same or similar feature.

DETAILED DESCRIPTION

Figure 1:
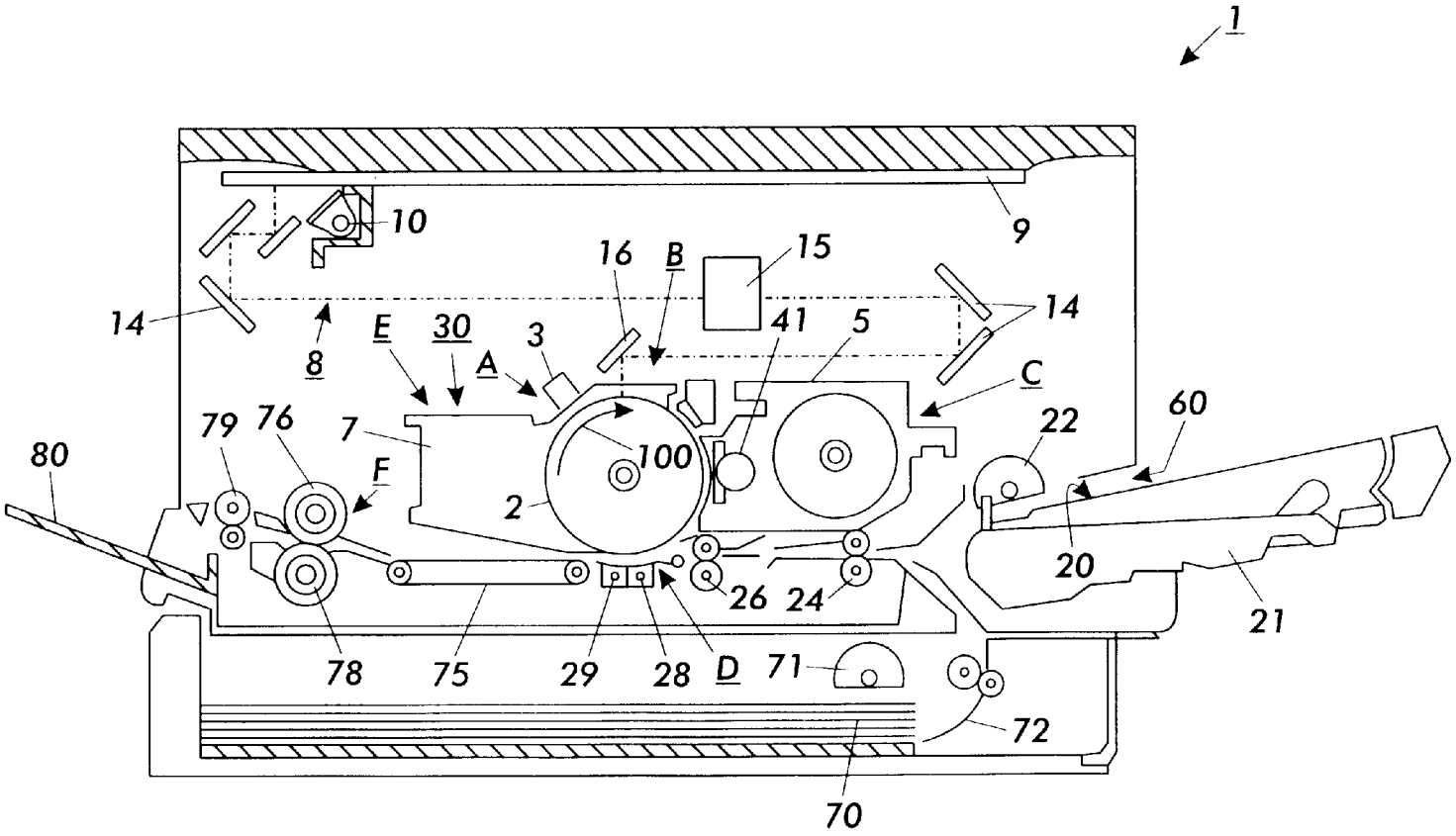
FIG. 1 is an elevational schematic view of an electrostatographic printing machine incorporating the present invention.

Referring first to FIG. 1, the electrostatographic printing machine 1 includes a photoreceptor 2 (also referred herein as drum 2) which is rotated in the direction indicated by the arrow 100 so as to pass sequentially through a series of xerographic processing stations; a charge station A, an imaging station B, a developer station C, a transfer station D and a cleaning station E. The drum 2, corona generating device 3, and cleaning housing 7, form a unit that is produced as a single module known as a customer replaceable unit (CRU) generally referred to as reference numeral 30, which is detachably mounted to the apparatus main body and is replaceable by the customer. The CRU containing the photoreceptor is also referred herein as the imaging module.

Initially drum 2 rotates a portion of the photoconductive surface to a charging station A. Charging station A employs a corona generating device indicated generally by the reference numeral 3, to charge the photoconductive surface to a relatively high, substantially uniform potential.

Thereafter, drum 2 rotates the charged portion of the photoconductive surface to exposure station B. Exposure station B includes an exposure mechanism indicated generally by the reference numeral 8 having a stationary, transparent platen 9, such as a glass plate or like for supporting an original document thereon. Lamp 10 illuminates the original document. Scanning of the original document is achieved by translating the lamp in a time relationship with the movement of drum 2 so as to create incremental light images which are reflected upon a fixed mirror 16 via mirrors 14 and an optical lens 15 onto the charged portion of the photosensitive drum 2. Irradiation of the charged portion of the photoconductive surface of the drum 2 records an electrostatic image corresponding to the informational areas contained within the original document. Obviously, electronic imaging of the page information could be facilitated by a printing apparatus utilizing electrical imaging signals. The printing machine can be a digital copier including an input device, such as a raster input scanner (RIS) and a printer output device, such as a raster output scanner (ROS), or, a printer utilizing a printer output device such as a ROS.

Subsequently, the electrostatic latent image is developed at developer station C. At the developer station, developer material from a developer housing 5 is caused to flow in contact with the surface of the drum 2 using a developer roll 41 positioned adjacent to the drum 2. The developer material in the form of charged toner particles is attracted to the image area of the drum 2 to form a visible toner image. As seen in FIG. 1, the developer housing 5 containing the developer material and the developer roll 41 can be separate from the CRU containing the photoreceptor. The surface of the moving drum 2 then transports the toner image to transfer station D. Cut sheets of support material 20 are fed from the input tray 21 by sheet feeder 22 to the transfer station D via delivery rollers 24 and timing rollers 26 in synchronous relationship with the image on the surface of the drum 2. The backside of the sheet is sprayed with ions discharged from a transfer corotron 28 inducing on the sheet a charge having a polarity and magnitude sufficient to attract the toner material from the surface of the drum 2 to the sheet. The induced charge also electrostatically tacks the sheet to the drum 2. Subsequently, a second transfer corotron 29 induces an opposite charge on the sheet to facilitate the removal of the sheet from the surface of the drum 2. Also, to facilitate removal of the sheet, a stripper finger may be utilized to move between the drum 2 and the sheet of support material 20 to lift the sheet from the surface of the drum 2. A sheet of support material may either be fed from the manual input 60, from the input tray 21, or from an auxiliary second input tray 70 by feeder 71 along path 72 to the aforementioned delivery rollers 24 and timing rollers 26.

The surface of the drum 2 continues along its rotational path passing cleaning station E, whereat the residual toner remaining on the surface of the drum 2 is removed prior to the charging thereof at charging station A. At the cleaning station E, the residual toner is mechanically cleaned from the surface of the drum 2, by means of a blade or the like. The toner is then collected within the cleaning housing 7. The residual toner may be collected and transported back to the developer housing 5 by suitable means, such as a conveyor moving in an endless loop through a tube. The collected residual toner can then be deposited in the developer mix within the developer housing 5 so that it can be reused in the developing process.

Following transfer and stripping, the sheet is transferred along transfer belt 75 to fusing station F. The fusing station F comprises an upper fuser roll 76 and a lower fuser roll 78 mounted in operative relation to each other and arranged to interact so as to support the sheet of support material in a pressure driving contact therebetween. At least one of the two rolls is heated (as shown, the upper roll 76), with the other roll typically being a simple pressure roller (as shown, the lower roll 78). As the heated roll 76 is rotated, the heated surface thereof is pressed into contact with the image face of the sheet. Mechanical and heat energy is transferred from the roll surface to the sheet of support material permanently bonding the toner particles thereto. Upon leaving the fusing station F, the sheet having the image fixed thereto is discharged into a copy tray 80 by discharge rollers 79.

After producing the prescribed number of copies, the CRU 30 is replaced by the customer.

Figure 2:
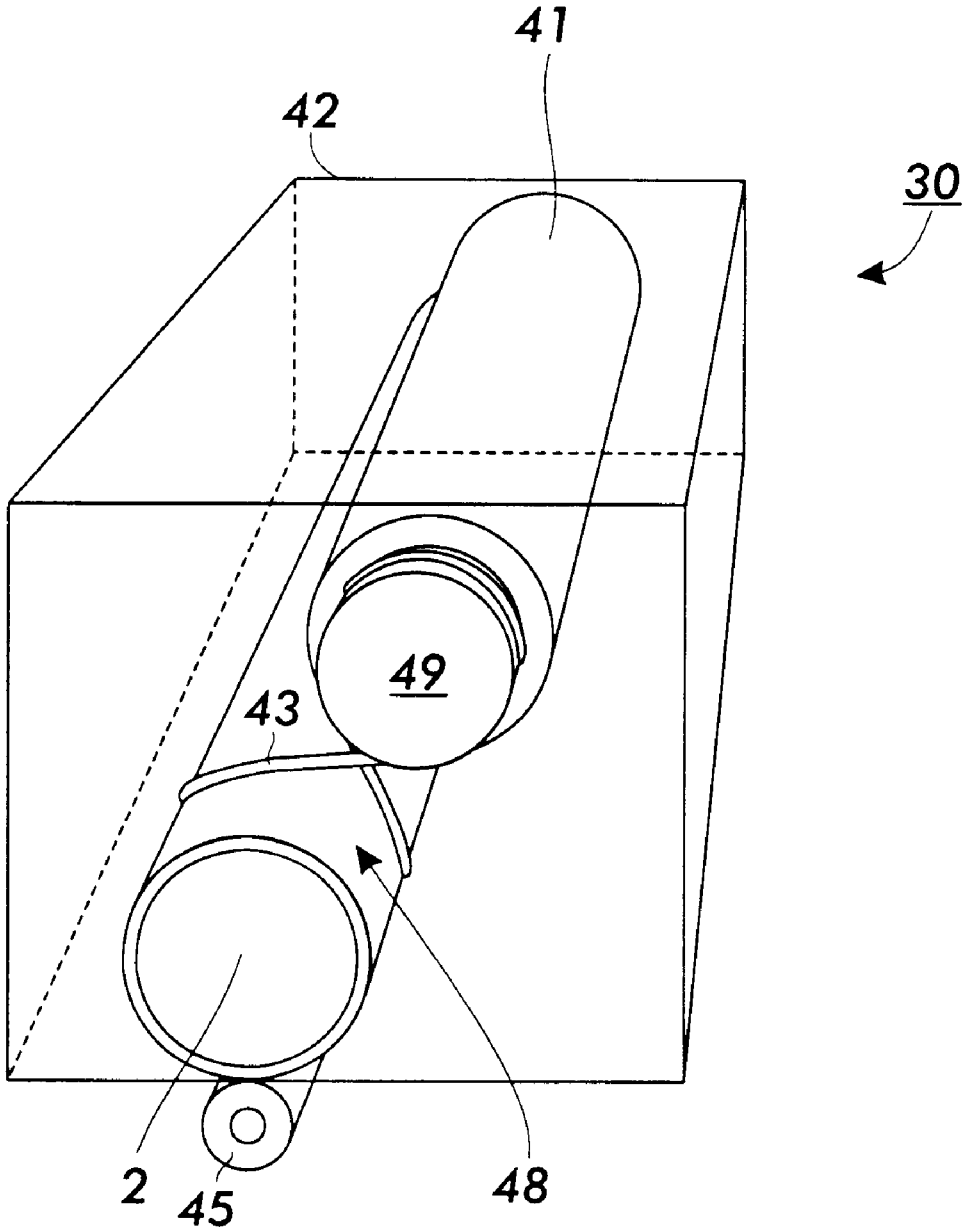
FIG. 2 is a perspective schematic view of one embodiment of the present imaging module.

In FIG. 2, the imaging module 30 includes at least the housing 42, the photoreceptor 2, the developer roll 41, and the frictional drive apparatus 43 which is depicted as a belt of preferably circular cross-section (a flat belt alternatively can be used) wrapped in a "figure eight" configuration around a non-imaging area 48 of the photoreceptor and a drive region 49 of the developer roll. The photoreceptor can have one or two non-imaging areas, such non-imaging areas being located along the end regions. The developer roll drive region 49, which comes into contact with the frictional drive apparatus 43, may be a section of reduced diameter along the length of the developer roll; alternatively, the drive region can be a flange coupled to the developer roll. When the imaging module 30 is installed in the printing machine, the frictional drive apparatus 43 can contact a friction drive wheel 45 (which can receive power) that is located adjacent the photoreceptor. The developer material may be in the imaging module or in another unit.

Figure 3:
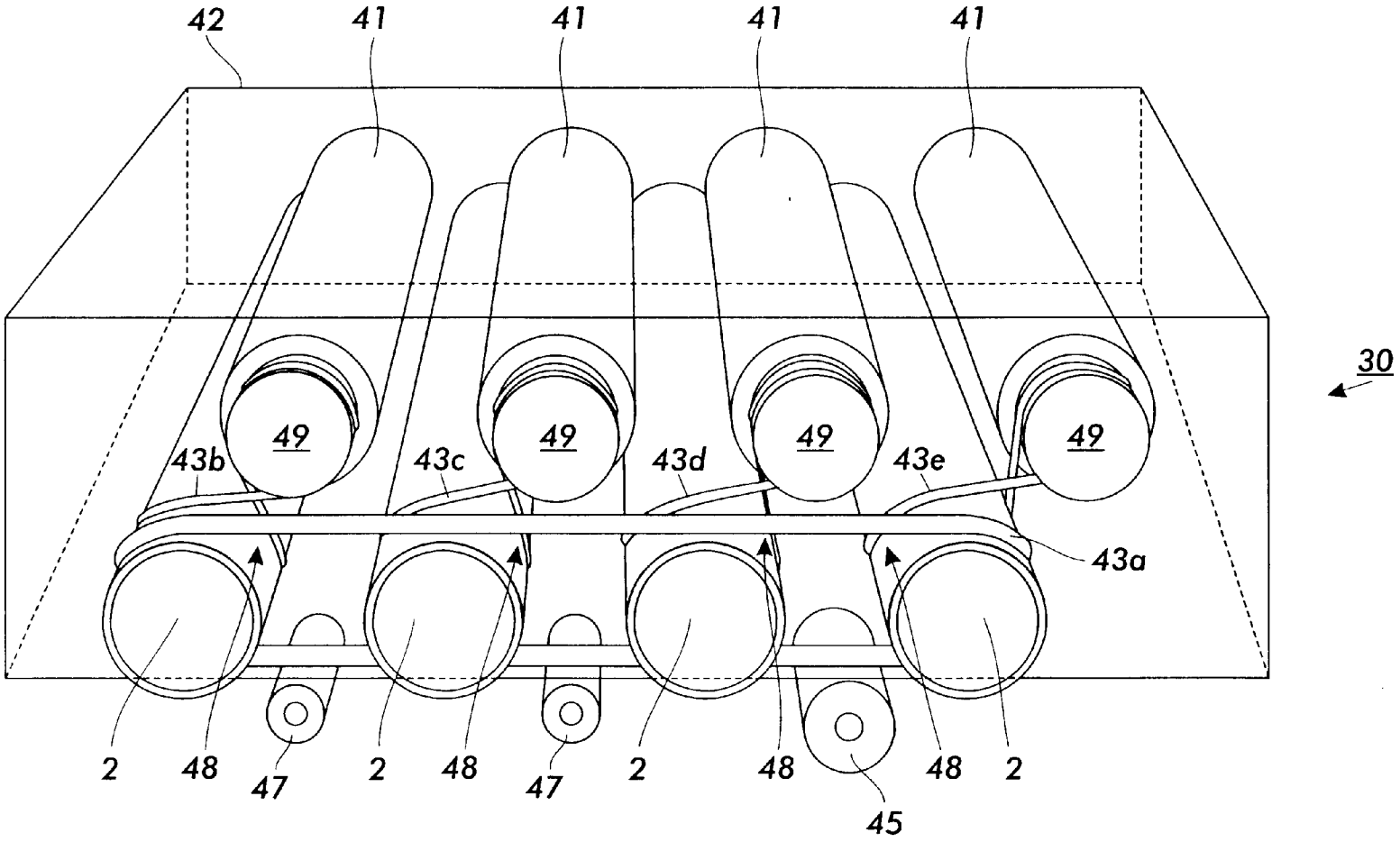
FIG. 3 is a perspective schematic view of a second embodiment of the present imaging module.

In FIG. 3, the imaging module 30 includes at least the housing 42, a plurality of photoreceptors 2 such as two, three, four or more, a corresponding number of developer rolls 41 such as two, three, four, or more, and the frictional drive apparatus (43*a–e*) is depicted as a plurality of belts. Each photoreceptor can have two non-imaging areas, one non-imaging area per end region. A single belt (43*a*) is wrapped around the non-imaging area 48 along one end region of all the photoreceptors (i.e., the end regions extending toward the viewer). Along the same end region of all the photoreceptors, a belt (43*b,c,d,e*)(the belt can be flat or can have a circular cross-section) is wrapped in a "figure eight" configuration around the non-imaging area 48 of a photoreceptor and a drive region 49 of the corresponding developer roll. In alternative embodiments, the belts (43*b,c,d,e*) can be disposed on the opposite end regions of the photoreceptors from the single belt (43*a*). When the imaging module 30 is installed in the printing machine, the single belt (43*a*) can contact a friction drive wheel 45 (which can receive power) and idler rollers 47 that are located adjacent the photoreceptors 2. To improve frictional drive coupling between the belt (43*a*), which may be of arbitrary (but uniform) cross-section, and the photoreceptors (2), the idler rollers (47) and friction drive wheel (45) may be positioned closer to the plane (or curved planar surface) containing the axes of the photoreceptors, in order to increase the belt (43*a*) wrap angle around each photoreceptor (2). The advantage of the belt driven system illustrated in FIG. 3 is that it guarantees the same surface speed for all photoreceptors. If belt (43*a*) is driven at the same speed as the paper to which toner is to be transferred in an image-wise fashion, then registration noise will be minimized.

Figure 4:
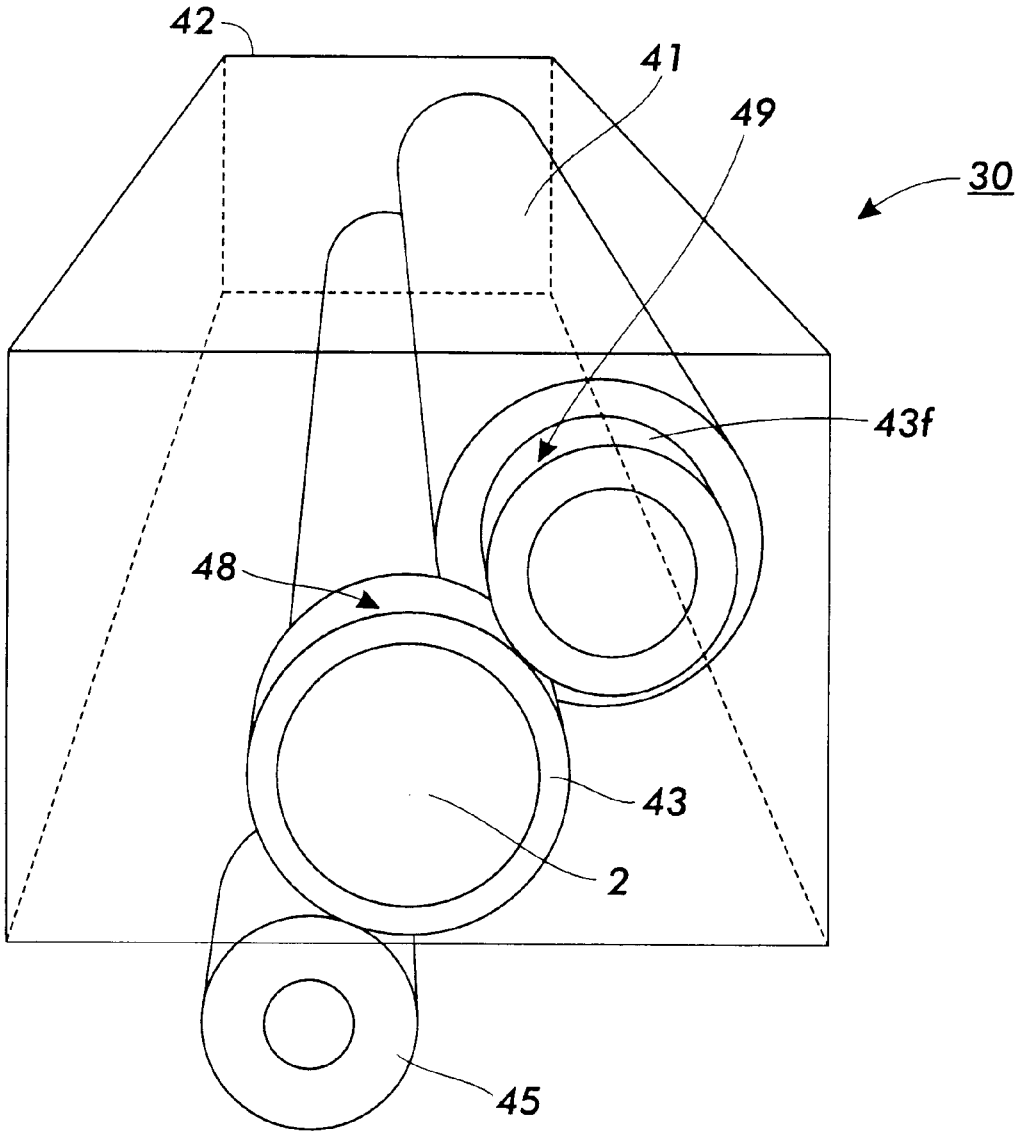
FIG. 4 is a perspective schematic view of a third embodiment of the present imaging module.

In FIG. 4, the imaging module 30 includes at least the housing 42, the photoreceptor 2, the developer roll 41, and the frictional drive apparatus 43 which is depicted as an O-ring wrapped around a non-imaging area 48 of the photoreceptor. The O-ring is in frictional contact with the drive region 49 of the developer roll. The frictional drive apparatus optionally can include a gripping surface 43*f* provided by for example a layer of a rubber-like material on the drive region 49 of the developer roll to improve the frictional contact. When the imaging module 30 is installed in the printing machine, the frictional drive apparatus 43 on the photoreceptor non-imaging area can contact a friction drive wheel 45 (which can receive power) that is located adjacent the photoreceptor 2.

As described herein, the present invention replaces the more complicated and expensive gear train seen in conventional CRUs with one employing frictional drive. The photoreceptor generally has a larger diameter than the diameter of the drive region of the developer roll to ensure incommensurate surface speeds needed for good toner development. The ratio of radii between the photoreceptor and the drive region of the developer roll determines the surface speed ratio. For a belt driven system incorporated within the CRU, the only source of registration noise would then be differential elastic elongation of the drive belt around its circuit. Since a drive belt must be flexible, elastic elongation is an intrinsic property of a drive belt. However, registration errors can occur for differential elastic elongation, as might occur for stick-slip motion of a photoreceptor in a poor sleeve bearing. Such errors can be minimized below gear-drive noise levels by proper choice of drive belt elastic constants, belt tension, and adequate low friction bearing surfaces for the photoreceptors. Additionally, composite belt designs employing high friction rubber-like surfaces over a non-extensible fiber core, such as in standard drive belt designs, would minimize such differential elastic elongation. The magnitude of elongation errors is proportional with the overall dimensions of the drive belt, which also is proportional with the diameters of the photoreceptors. Consequently, the smaller the photoreceptor diameter driven by a belt, the smaller the absolute registration error due to the belt drive differential elongation.

In embodiments of the present invention, the developer roll is driven by a conventional gear system instead of the present frictional drive apparatus. One end region of the developer roll may have either a groove or a smaller diameter section, or even be attached to a smaller diameter flange, to accept for example a belt or friction wheel. The groove/smaller diameter section of the developer roll or the attached flange is referred to as the drive region of the developer roll.

Both the photoreceptor and the developer roll preferably should ride in low friction mounts, but neither need be on ball bearings or shafts, so long as the resulting mechanical friction creates torques lower than the drive tension in the frictional drive apparatus. A preferred low friction coupling of the photoreceptor to the housing may be, for example, to provide a low surface energy sleeve or grommet, such as made from Teflon, or even nylon, within which the cylindrical photoreceptor tube could rotate. Lateral, axial motion could be inhibited by suitable low friction Teflon or nylon stops at either end of the tube. Alternatively, spring loaded coaxial Teflon or nylon cones could protrude into the photoreceptor tube from either or both ends to provide both radial and lateral positioning, while allowing low friction rotational motion. Similar mounting schemes could apply to the developer roll.

The photoreceptor may be either an organic or inorganic type. The diameter of the photoreceptor ranges for example from about 10 mm to about 10 cm, and preferably from about 10 mm to about 30 mm.

Suitable materials for the belts and O-rings of the frictional drive apparatus include for instance butyl rubber, neoprene-based rubber, isoprene-based rubber, and butylidene-based rubber. Specific dimensions and the need for flexible cord reinforced composite construction would be determined from analysis of the frictional load and intended service life in the particular application considered. In general, some elastic deformation of the contacting surface of the drive belt or wheel will aid in ensuring transfer of power. However, such deformation need not be great if the contact wrap angle and normal force (or drive belt tension) is sufficient to provide the torque required to overcome the frictional drag of the various bearing surfaces, developer drag, and paper transport in the printing machine. For example, a continuous band of nickel, as might be fabricated using electroforming technology could be sufficiently wrapped and tensioned by a spring loaded idler wheel to drive an aluminum, stainless steel, or nickel tube substrate photoreceptor. Such a nickel drive belt would exhibit negligible creep, stretch, or extension over a service life of many hundreds of thousands of cycles.

In the present invention, by linking drive motion to achieve constant surface velocity at, say, the point of image transfer, positional uncertainties due to variations in radius of the photoreceptor are on average smaller than in the case of constant rotational velocity. First order perturbation theory applied to rotational motion shows that the average uncertainty in the exposure position is proportional to $<\Delta r(\Theta)>$ in the case of constant rotation, but proportional to $<\Delta r(\Theta)-\Delta r(\Phi)>$, where $\Phi=\Theta+\Theta_0$, $\Theta_0$ being the angular distance between exposure and point of transfer. Representing $\Delta r(\Theta)$ as a Fourier integral, and averaging over $\Theta$ results in $2_0{}^{\infty}a(k)_0{}^{2\pi}e^{ik\Theta}d\Theta dk$ and $2_0{}^{\infty}a(k)[1-\cos(k\Theta_0)]_0{}^{2\pi}e^{ik\Theta}d\Theta dk$ for the means for constant rotation and constant surface velocity cases, respectively. In general, especially for small $\Theta_0$, the former maximizes the latter.

Other modifications of the present invention may occur to those skilled in the art based upon a reading of the present disclosure and these modifications are intended to be included within the scope of the present invention.

I claim:

1. A detachable imaging module for an electrostatographic printing apparatus, comprising:

(a) a housing;

(b) a cylindrical, rotatable photoreceptor at least partially disposed within the housing, wherein the photoreceptor has a non-imaging area;

(c) a developer roll at least partially disposed within the housing; and (d) a frictional drive apparatus in contact with the non-imaging area for facilitating rotation of the photoreceptor by frictional contact, wherein there is absent a rotational drive gear coupled to the photoreceptor, wherein the frictional drive apparatus comprises a belt wrapped around the non-imaging area of the photoreceptor and wherein the belt also is wrapped around the developer roll.

2. The module of claim 1, wherein the photoreceptor has a larger diameter than the developer roll.

3. The module of claim 1, wherein the developer roll defines a section of reduced diameter.

4. The module of claim 1, further comprising a plurality of other cylindrical, rotatable photoreceptors each having a non-imaging area wherein the frictional drive apparatus contacts the non-imaging area of each of the plurality of the other photoreceptors, wherein there is absent a rotational drive gear coupled to each of the plurality of the other photoreceptors.

* * * * *